US006843616B2

(12) United States Patent
Sychra

(10) Patent No.: US 6,843,616 B2
(45) Date of Patent: Jan. 18, 2005

(54) EROSION CONTROL PANELS

(76) Inventor: Donald Eugene Sychra, 135 Wyldewoode Dr., McDonough, GA (US) 30253

( * ) Notice: Subject to any disclaimer, the term of this patent is extended or adjusted under 35 U.S.C. 154(b) by 0 days.

(21) Appl. No.: 10/657,531

(22) Filed: Sep. 8, 2003

(65) Prior Publication Data

US 2004/0047687 A1 Mar. 11, 2004

Related U.S. Application Data

(60) Provisional application No. 60/409,657, filed on Sep. 10, 2002.

(51) Int. Cl.[7] ..... E04H 17/00

(52) U.S. Cl. ..... 405/32; 405/302.7; 210/170; 256/12.5; 256/24; 256/32

(58) Field of Search ..... 256/23, 24, 25, 256/32, 45, 47, 12.5; 405/30, 32, 302.6, 302.7; 210/170

(56) References Cited

U.S. PATENT DOCUMENTS 697,259 A * 4/1902 Lavely ..... 256/32
1,476,853 A * 12/1923 Tabor ..... 256/1
3,423,072 A * 1/1969 Bernstein ..... 256/32
4,773,437 A * 9/1988 Glutting ..... 256/32
5,156,496 A * 10/1992 Vidal et al. ..... 405/302.7

* cited by examiner

*Primary Examiner*—John Kreck
(74) *Attorney, Agent, or Firm*—David P. Kelley

(57) ABSTRACT

An erosion control device is a panel formed of spaced horizontal and spaced vertical rods joined together to create a frame upon which is mounted a sheet of silt fencing material. A plurality of such panels may be rotatably joined together to form different configurations of erosion control fencing. The panels are reusable and the silt fencing material may be replaced thereon. The silt fencing material may be used to form a pocket for sand, thus forming a sandbag at the base of the panel for controlling water flow. The panel may have affixed thereto at the base a narrow metallic strip for cutting into the ground as the panel is forced downward thereon.

12 Claims, 3 Drawing Sheets

EROSION CONTROL PANELS

This application claims priority to copending U.S. provisional application entitled, "Georgia Panels" having Ser. No. 60/409,657, filed Sep. 10, 2002, which is entirely incorporated herein by reference.

FIELD OF THE INVENTION

This invention relates to erosion control devices generally for use at construction sites.

BACKGROUND OF THE INVENTION

At construction sites there is usually a large amount of digging of ground, which results often in piles of loose dirt and gravel, or in large stretches of bare earth. Such earth or dirt piles, generally being non-compacted, and often even compacted, are subject to erosion by wind or, more particularly by rainfall. When such raw earth is adjacent to streets or roads, rain can and most often does, wash the dirt over the road, creating a muddy hazardous condition. When the raw earth is adjacent a drainage ditch or sump and drainage pipe, such can be clogged or even plugged or dammed by the dirt that is washed into the ditch, sump, and/or pipe.

It is usually the practice to place plastic sheeting between the raw earth and a street, road, or other path, which is done by driving spaced wooden stakes into the ground along the stretch to be protected, and tacking or stapling plastic sheeting thereto, to form a plastic fence or dam. Such an arrangement at least partially dams the flow of dirt (usually mud) but is subject to wear and tear, often collapsing when the dammed load becomes too great. This problem also arises when the plastic strip is used to protect a drainage ditch, for example.

In the case where a sump and/or drainage pipe is to be protected, the protective structure is not as simple. Generally, assuming, for example, a square shaped sump, a square ditch is dug paralleling the sides of the sump, and vertical steel posts are driven into the ground at the four corners of the square. These posts are cross braced at their tops and their verticality maintained usually by two-by-fours attached to diagonally opposed posts and to each other. It is the usual practice to stretch plastic or felt sheeting around the square formed by the posts, and material such as chicken wire can be used to support the fabric spans. It is often the case that a mesh material, known as silt fencing, is supported by the chicken wire instead of the plastic or felt. Silt fencing is commercially available and is a plastic mesh sheeting material which allows the passage of water, but blocks, at least to some extent, the passage of debris, e.g., earth and rocks. The material extends down into the trench and is covered by, for example, lumped dirt, to prevent debris passing through the bottom edge of the structure. The structure as just described is relatively expensive to construct and, further, can only be used once, having to be completely disassembled for removal.

It is desirable, therefore, that a relatively simple, effective erosion control arrangement that can be reused where needed be available that has the inherent versatility to protect a wide variety of situations from erosion, or the deleterious results thereof.

SUMMARY OF THE INVENTION

The present invention, in its basic form, is a panel formed of vertical and horizontal approximately one quarter inch in diameter metal rods, preferably aluminum, spaced approximately six inches apart and welded at their intersections. Such paneling is commercially available and is known as livestock fencing, and is both fairly rigid and strong.

In accordance with the principles of the invention, in a first embodiment thereof, assuming nine vertical rod panels of fencing, the two vertical end rods and the third, fifth, and seventh vertical rods extend below the lowest horizontal rod or to the lower ends of the vertical rods a distance of approximately one foot, while the alternate vertical rods (second, fourth, sixth, and eighth) extend below the lowest horizontal rod a distance of approximately three inches. It will be appreciated that there may be more or fewer vertical rods, with alternate rods being of different lengths. Additionally, while five horizontal rods are adequate for proper performance of the invention, there may be fewer or more such rods, depending on the particular need. A sheet of silt fencing material is attached at the top of the panel by puncturing it with the ends of the vertical rods, which extend slightly above the uppermost horizontal rod. When so punctured, with the rod ends extending therethrough, the top edge of the sheet is firmly attached to the panel. The lower ends of the short vertical rods are bent outward and puncture the lower portion of the silt fencing material, which is stretched taut, thereby fixing the sheet to the panel at the top and bottom.

Several panels can be joined together to form almost any desired shape by clamping the end vertical members at the top and bottom by means of hog rings, to be discussed more fully hereinafter, or other reusable clips. When so clamped, the panels may be moved or rotated relative to each other to form almost any desired polygonal shape.

In a second embodiment of the invention, a panel for use in such a milieu as road grading where it is impractical to trench the subgrade for controlling the flow of water. It may also be used for slope drain inlets for water velocity dissipation and one ditch paving. The panel is similar to the basic panel except, as will be seen hereinafter, the silt fencing material extends well past the lower end of the panel and is bent up and attached, as by hog rings to one of the intermediate horizontal rods, thus forming a pocket. The pocket may be filled with coarse sand or other suitable material so that the end of the completed panel functions as a sand bag to redirect flowing water, for example.

In still another embodiment of the invention, the panel of the first embodiment has a thin, flat aluminum strip affixed to the lower horizontal rod and extending the length of the panel with the plane of the strip being vertical. When the panel (or panels) is to be used where trenching is undesirable, such as on a grassy lawn, the panel is pressed down so that the aluminum strip makes a narrow cut in the ground but extends far enough into the ground to maintain the panel upright, in conjunction with the long vertical rods.

These and other features of the present invention will be readily apparent from the following detailed description, read in conjunction with the accompanying drawings.

DETAILED DESCRIPTION

Figure 1A:
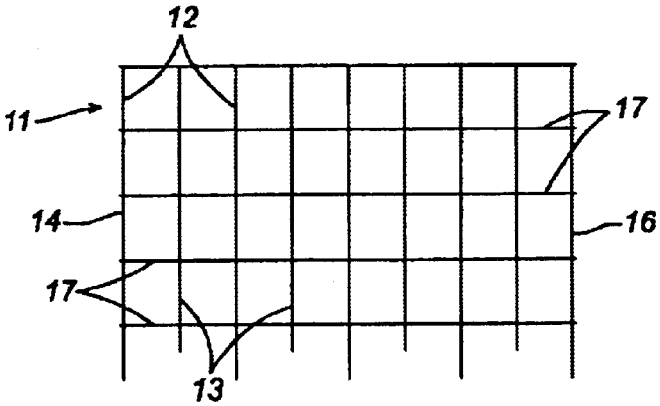
FIGS. 1(*a*) and 1(*b*) are front and side elevation views respectively of the basic unit of the present invention FIGS. 2(*a*) and 2(*b*) are views of a coupling means for coupling together two or more of the units for FIGS. 1(*a*) and 1(*b*)
Figure 1B:
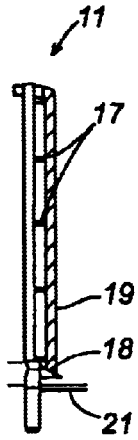

FIGS. 1(*a*) and 1(*b*) are, respectively, a front elevation view and a side elevation view of the basic panel 11 of the present invention. Panel 11 comprises a plurality of spaced vertical rods 12 and rods 13, and end rods 14 and 16. The rods are, preferably, 3/16–1/4 inch aluminum or galvanized steel, although other size rods of sufficient stiffness may be used. It is to be understood that there may be more or fewer vertical rods than the nine shown in FIG. 1(*a*), however, in the interests of portability, the number of vertical rods is preferably in a range, for example, of six to ten or twelve. As can be seen in FIGS. 1(*a*) and 1(*b*) end rods 14 and 16 and rods 12 are longer than rods 13, with which they alternate. The longer rods, as shown in FIG. 1(*a*) penetrate deeply into the ground (shown as a wavy line) to anchor the panel securely in upright position. A plurality of spaced horizontal rods 17 extend across the panel and are welded or otherwise affixed at their junctions with the vertical rods. As can be seen more clearly in FIG. 1(*b*), the vertical rods 12, 13, 14 and 16 extend slightly above the uppermost horizontal rod 17. Also, as best seen in FIG. 1(*b*), the lower ends of rods 13 are bent outward to form anchors 18 for a sheet 19 of silt fencing material, which is a fine mesh material of plastic or other suitable material. The sheet 19 is stretched tight and anchored at the top of the panel by penetration of the upper extensions of the vertical rods into the mesh of sheet 19. As seen in FIG. 1(*b*), sheet 19 has a flap overlap 21 at the bottom of the panel, upon which dirt, stones, bricks or the like may be placed to prevent silt from passing under the panel.

In use, the panel 11 is installed by the operator first digging a narrow trench approximately three inches deep. The bottom of the panel is then placed in the trench and the panel is forced down to make the bottom extensions of the vertical rods 12, 14, and 16 penetrate the ground to a depth where the bottom horizontal rod is at ground level or slightly below. The trench is then back filled.

Figure 2A:
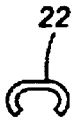
Figure 2B:
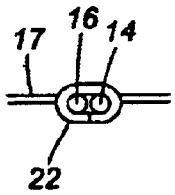

As pointed out in the foregoing, one of the principal features of the present invention is that the panel 11 obviates the necessity of wood and/or steel posts to which it is time consuming to attach a long length of silt fencing material or other plastic sheeting. Where long lengths of silt blocking are required, individual panels may be movably coupled to each other by means of hog rings, as shown in FIGS. 2(*a*) and 2(*b*). Hog ring 22 which is generally made of a semi-pliable metal, is shown in its open position in FIG. 2(*a*). In FIG. 2(*b*), ring 22 is shown in its closed position, having been squeezed around the end rods 14 and 16 of two panels. Ring 22 holds the vertical rods 14 and 16 together, but permits rotation of the panels 11 relative to each other. Rings 22 should be used in more than one place on the end rods 14 and 16, at the top and at the bottom end region, such as just below the lowermost horizontal rod 17, for example. Thus several panels may be strung together to extend for any desired length. Further, where special shapes are required, the panels may be rotated relative to each other, as will be discussed hereinafter.

Figure 3:
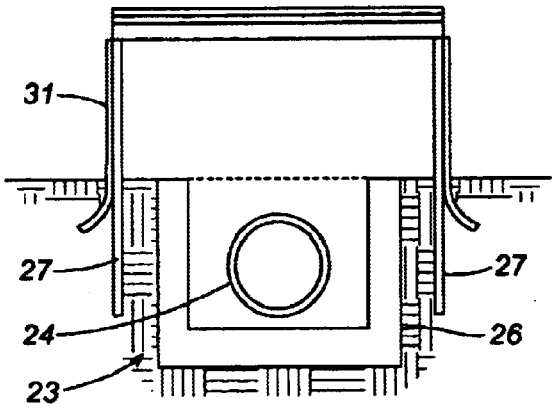
(Prior Art) Fig. 3
FIG. 3 is an elevation view of a prior art arrangement for erosion control.
Figure 4:
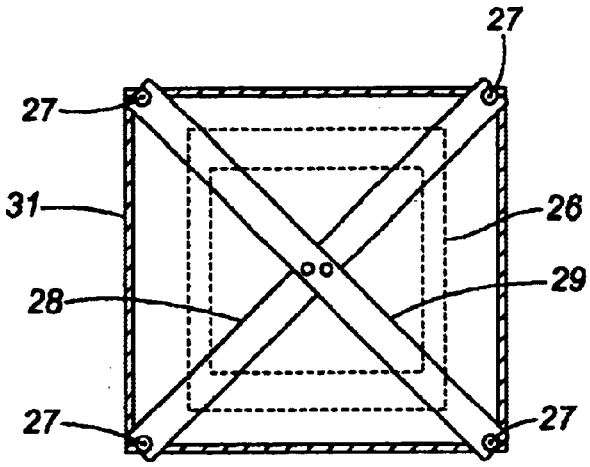
(Prior Art) Fig. 4
FIG. 4 is a top plan view of the arrangement of FIG. 3.

In FIGS. 3 and 4 there is shown a drainage pipe and square sump arrangement 23. The pipe 24 opens into the sump 26 which forms a catch basin for water which is carried away by pipe 24. A typical prior art arrangement for preventing silt, dirt, rocks, etc. from accumulating in the sump 26 comprises four metal rods 27, preferably of steel, driven into the ground at the four corners of the sump 26, spaced therefrom as best seen in FIG. 4. First 28 and second 29 bracing members extend between diagonally opposed rods 27, forming an X configuration and are nailed or bolted together at their intersection. Members 28 and 29 may be, for example, wooden two-by-fours, and are notched at their ends to hold the posts 27. Typically, a sheet of plastic or felt is stretched about the perimeter of the square thus formed. It can be appreciated that it takes time to assemble such an arrangement and, when it is no longer necessary, it is usually scrapped, having had a very specialized used.

Figure 5:
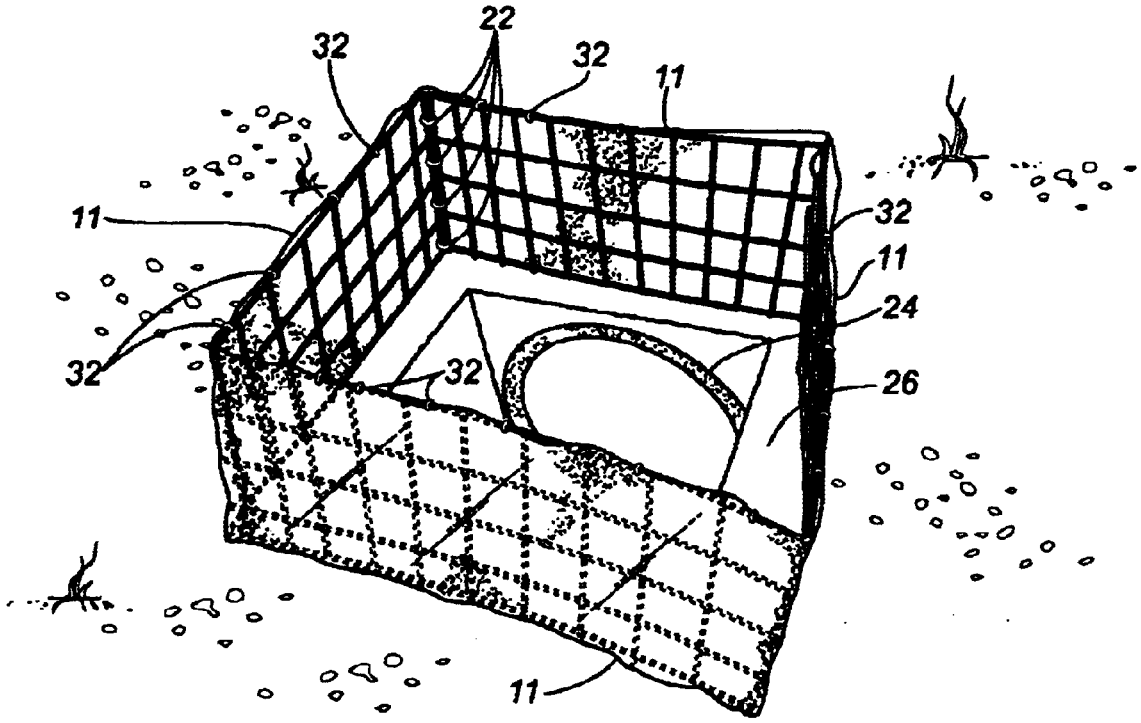
FIG. 5 is a perspective view of the units of the present invention as used in erosion control.

FIG. 5 is a perspective view of the drainage pipe 24 and sump 26 shown in FIGS. 3 and 4, protected by four substantially identical panels 11, as depicted in FIGS. 1(*a*) and 1(*b*) which are held together by hog rings 22. Additional small hog rings or other type clips 32 are shown for additionally securing the top of the sheets 19, each to its respective panel frame. When the silt barrier is no longer needed, it is only necessary to detach the hog rings 22 and take the four now separate panels away. The panels may be used again and again, it only being necessary to remove the dirty and clogged sheet 19 from each panel and replacing it with a clean sheet 19.

Figure 6:
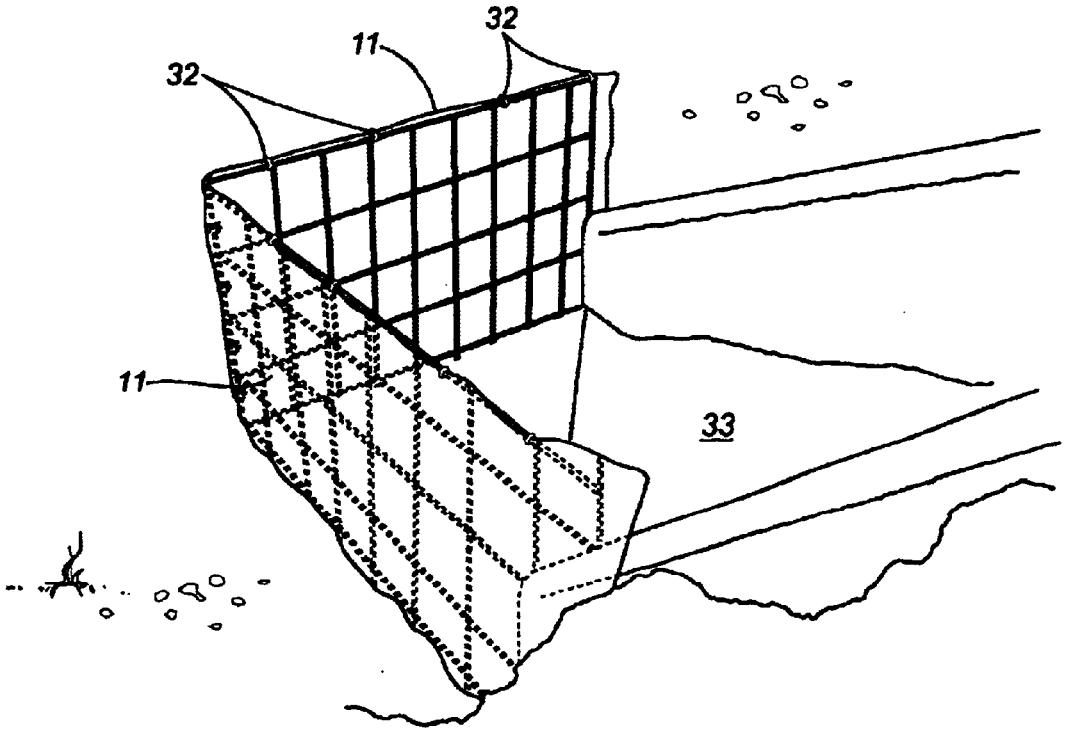
FIG. 6 is a perspective view of the units of the present invention as used in erosion control.

FIG. 6 is a perspective view of another configuration of panels 11 for use with a tapered flume 33 amplifying into a drain pipe (not shown). In this arrangement, only two panels 11 are necessary to form an L-shaped barrier in front of the flume 33, and, as in the configuration of FIG. 5, when no longer needed, the panels 11 can be disconnected and removed until needed again.

Figure 7A:
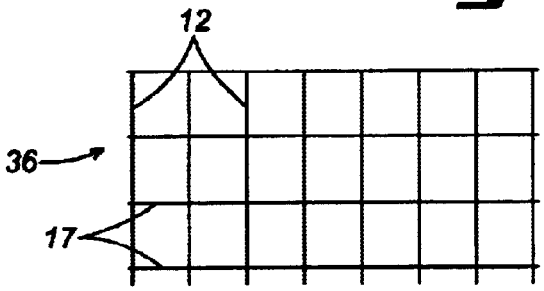
FIGS. 7(*a*) and 7(*b*) are, respectively, front and side elevation views of a modified unit for controlling water flow as well as erosion control.
Figure 7B:
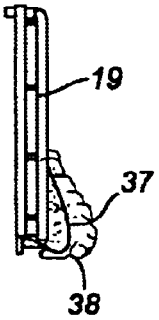

It is often the case, especially in construction projects such as road building, where erosion control involves the control of water flow. Thus, in road subgrading, prior art types of silt fences, as discussed hereinbefore, are not usable because of the need to dig a trench for the silt fence, which contractors do not want to do. Further, the prior art type of silt fence does not control silt laden water flowing parallel to it, nor is it usually strong enough to withstand incursion of water at high velocities. In FIGS. 7(*a*) and 7(*b*) there is shown the basic panel 36 of the invention for use in controlling water flow wherein the silt fencing material 19 extends much farther below the bottom horizontal bar 17 and is looped up and its end attached to one of the intermediate horizontal members 17 by any suitable means such as wire clips or hog rings (not shown), thereby forming a pocket 37 which is filled with sand or other water resistant material 38, thereby forming a sand bag at the base of the panel 36, which stems the flow of the water through the panel 36. Because the panels 36 may be arranged when joined together in any desired configuration, they may be used to channel the water flow or to attenuate its velocity.

Figure 8A:
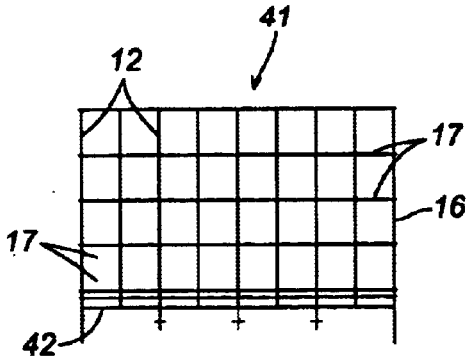
FIGS. 8(*a*) and 8(*b*) are, respectively, front and side elevation views of a unit embodying the features of FIGS. 1(*a*) and 1(*b*) as modified for use in areas where trenching is undesirable.
Figure 8B:
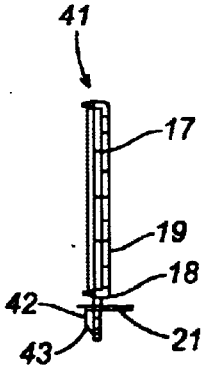

FIGS. 8(*a*) and 8(*b*) depict a modification 41 of the panel 11 of FIGS. 1(*a*) and 1(*b*). The modification comprises a thin horizontal strip 42, preferably of suitable metal, welded to the lowermost horizontal strip 17. When the panel 41 is to be used on a surface where trenching is undesirable, such as a grassy lawn, the strip 42, preferably having a pointed lower edge 43 cuts a very narrow slit in the lawn upon downward pressure, thus allowing the vertical strips 12, 14, and 16 to be sunk below the lawn's surface for insuring a rigid upright panel.

It is to be understood that the various features of the present invention might be incorporated into other types of erosion control arrangements, and that other modifications or adaptations might occur to workers in the art. All such variations or modifications are intended to be included herein as being within the scope of the invention as set forth herein. Further, in the claims hereafter, the corresponding structure, materials, acts, and equivalents of all means or step-plus-function elements are intended to include any structure, materials, or acts for performing the functions in combination with other elements as specifically claimed.

Therefore, having thus described the invention, at least the following is claimed:

1. An erosion control device comprising:

a panel having a plurality of spaced vertical rods having upper and lower ends and a plurality of spaced transverse rods having uppermost and lowermost rods affixed to said vertical rods to form a panel frame;

the two end vertical rods extending below the lowermost transverse rod a sufficient distance to allow penetration of the vertical rods into the ground or other material;

alternate first ones of said vertical rods having substantially the same extension as the two end rods;

a plurality of second vertical rods alternating with said first ones of said vertical rods;

each of said first and second vertical rods having a portion extending, at the upper end thereof, above the uppermost transverse rod;

said second rods at the lower end thereof having a portion extending below the lowermost transverse rod;

that portion of the second vertical rods extending below the lowermost transverse rod having a bent portion extending from said panel; and a sheet of silt fencing material held in place by said extending portions at the upper ends of said vertical rods and by said bent portions at the lower ends of said second rods.

2. An erosion control device as claimed in claim 1 wherein said vertical and transverse rods are made of aluminum.

3. An erosion control device as claimed in claim 1 wherein said vertical and said transverse rods are from three-sixteenths of an inch to one-quarter of an inch in diameter.

4. An erosion control device as claimed in claim 1 wherein said lowermost transverse rod has welded thereto a transversely extending thin strip of metallic material.

5. An erosion control device as claimed in claim 4 wherein said metallic material is aluminum.

6. An erosion control device as claimed in claim 4 wherein said strip has a sharpened lower edge.

7. An erosion control device as claimed in claim 1 wherein said sheet of silt fencing material has a lower portion which extends beyond said lowermost transverse rod.

8. An erosion control device as claimed in claim 7, wherein said lower portion of said silt fencing material sheet is bent upward and fastened to a transverse rod located above said lowermost rod, forming a pocket in said sheet.

9. An erosion control device as claimed in claim 8, wherein said pocket is filled with a water resistant material.

10. An erosion control device as claimed in claim 9 wherein said water resistant material is sand.

11. An erosion control device as claimed in claim 1 and further including one or more substantially identical panels, said one or more panels being pivotally joined to each other at the vertical end rods thereof by clip members.

12. An erosion control device as claimed in claim 11 wherein said clip members are hog rings.

* * * * *